United States Patent [19]

Yen et al.

[11] Patent Number: 4,598,754

[45] Date of Patent: Jul. 8, 1986

[54] METHOD OF CONTROLLING METALLURGICAL STRUCTURE OF CAST ALUMINUM

[75] Inventors: Chia-Ming Yen, West Bloomfield; Gerald S. Cole, Franklin; Roman M. Nowicki, Bloomfield Hills, all of Mich.

[73] Assignee: Ford Motor Company, Dearborn, Mich.

[21] Appl. No.: 635,951

[22] Filed: Jul. 30, 1984

[51] Int. Cl.[4] ..... B22D 27/00; B22D 46/00

[52] U.S. Cl. ..... 164/4.1; 164/150; 164/57.1

[58] Field of Search ..... 164/4.1, 457, 150, 154, 164/155, 55.1–58.1

[56] References Cited

U.S. PATENT DOCUMENTS 4,333,512 6/1982 Sugiura et al. ..... 164/150

FOREIGN PATENT DOCUMENTS 2849598 6/1979 Fed. Rep. of Germany ..... 164/4.1

OTHER PUBLICATIONS

"A Method of Thermal Analysis of Aluminum Alloys Prior to Casting", Sals brochure of Societe De Vente De L'Aluminum Pechiney, 1982.

*Primary Examiner*—Kuang Y. Lin

*Attorney, Agent, or Firm*—Joseph W. Malleck; Roger L. May

[57] ABSTRACT

A method is disclosed for controlling the metallurgical structure of cast metals containing nonmetallic second phase structures. The method comprises (1) prior to making casting of the metal, determining a mathematical value associated with the rate of temperature change at liquidus recalescence and a value associated with the rate of temperature change at the eutectic arrest of a measured cooling curve for a sample of the metal melt; (2) comparing the determined values obtained with previously gathered values of the same type that have been correlated to known metallurgical structures; and (3) if the determined values are different than previously gathered values for a desired structure, add modifying and/or refining agents to promote a metallurgical structure change in the melt.

13 Claims, 5 Drawing Figures

METHOD OF CONTROLLING METALLURGICAL STRUCTURE OF CAST ALUMINUM

BACKGROUND OF THE INVENTION AND PRIOR ART STATEMENT

The quality and mechanical properties of a metal casting depend greatly on its metallurgical structure. In metals which contain nonmetallic second phases, the structure of both the initial or as-cast grain structure as well as the structure of the second phases is important because they both influence the quality and mechanical properties of the metal casting. In castings of aluminum alloys which contain silicon, or in iron alloys which contain carbon, the metallurgical structure of the nonmetallic second phase (silicon and carbon, respectively) can be altered by the addition of certain elements which affect crystallization behavior and thereby the metallurgical structure. These additions can change the nucleation and/or the growth characteristic while refining the grain size and/or the eutectic structure in a manner to improve the overall properties of the casting material. Knowing how much and when to make such additions is a difficult problem.

The level of grain refinement and eutectic modification have been evaluated traditionally by metallographic techniques requiring lengthy off-line sample preparation and examination with an optical microscope. Such traditional method involves either sectioning actual castings or sectioning a small sample of the metal which has been solidified. In either case, it is laborious to examine it metallographically. After examination and comparison to standardized photomicrographs, recommended additions can be made to the molten metal so that the desired grain structure and nonmetallic phase structure is promoted. Due to the variation of both parameters with time, the laboratory sample often differs markedly from the melt at the time the actual production casting is poured. This results in inaccurate additions that are needed for the actual production casting.

It would be helpful if some type of rapid on-line thermal analysis could accurately predict the amount of additions to be made. It is well established that major characteristics of the final cast structure are determined during solidification and, therefore, are reflected in the metal's cooling curve, a cooling curve being a plot of the variation of temperature with the lapse of time (see U.S. Pat. Nos. 3,478,808; 3,358,743; 3,991,808). However, it has been difficult to quantify the relationships between the metallurgical structure and relevant parts of the cooling curve, especially within the time constraints of the production environment. In the past few years an attempt has been made to do just that. In U.S. Pat. No. 4,333,512 a method was developed whereby the difference between the lowest and highest temperatures (temperature difference $\Delta T$) within a specfic phase transition region of the cooling curve is measured and related to previous trials which indicate what metallurgical structures will be obtained with a specific temperature difference at such curve portion. The beginning phase transition temperature and ending phase transition temperature are compared to render the sensed temperature difference, $\Delta T$. No attempt was made to relate such measured $\Delta T$ value to time. Similarly, in a French publication (see sales brochure of Societe De Vente De L'Aluminum Pechiney, 1982), the same type of measurement of the temperature difference at a specific phase transition region of the cooling curve was measured and related to the metallurgical structure for the same type of temperature difference ($\Delta T$). With the French method, a thermocouple is embedded in an interchangeable crucible used to make solidification samples of a melt. The sensed temperature difference ($\Delta T$) at selected portions of the cooling curve is then compared against one standard temperature difference ($\Delta T$) representing the desired metallurgical structure.

The above mentioned methods are quite adequate if the transition temperatures and, therefore, the resultant temperature difference ($\Delta T$) of the solidifying alloy are consistent, accurately measurable, and affected only by the structure. However, the measured transition temperatures and, therefore, the temperature difference ($\Delta T$) can also be affected by other factors, notably the chemistry of the alloy. Thus, a misleading prediction of the structure may result if, for example, there is a fluctuation in the alloy chemistry among samples or if the transition temperatures cannot be measured accurately due to some other reasons. As an example, what may happen is that the measured difference ($\Delta T$) between two samples will not represent different metallurgical structures but actually be due to only a fluctuation in alloy chemistry with generally the same metallurgical structures.

It would be highly desirable to develop a rapid on-line melt monitoring method which can tolerate some inconsistencies in phase transition temperatures due to fluctuation in alloy chemistry or difficulties in obtaining accurate transition temperatures.

SUMMARY OF THE INVENTION

The invention is a method of controlling the metallurgical structure of cast metals containing a nonmetallic second phase. The method comprises essentially (1) prior to casting a melt of said metal, determining a mathematical value associated with the rate of temperature change at liquidus recalescence and a value associated with the rate of temperature change at the eutectic arrest of the measured cooling curve for a portion of a melt whose structure is to be controlled, (2) comparing the determined value associated with a liquidus recalescence and the determined value associated with eutectic arrest with previously gathered values of the same type that have been correlated to known metallurgical structures, and (3) if one or both of the determined values are different than the previously gathered values for a desired similar structure, respectively, add refining agents and/or modifying agents to the melt to promote a desired metallurgical structure change.

For Al-Si alloys, it is preferable to employ strontium or sodium as a modifier or growth inhibitor to effect a desired change in the eutectic arrest, and to employ titanium and/or boron as a refining agent to effect a desired change in the liquid recalescence and a change in the grain size through increased nucleation sites.

Preferably, the aluminum based alloy contains silicon in the range of 5–12%.

Advantageously, the rate of temperature change may be determined by (a) taking the first derivative (slopes) of the measured cooling curve, (b) multiplying the first derivative curve by an amplifying factor (usually in the range of 1–100) and translating the amplified curve upwardly to define a domain of analysis above zero rate of change (usually an amount in the range of 0.1–7), and (c) integrating the area under the domain of analysis of the curve to render the mathematical values associated with recalescence and the eutectic arrest. The integrated value for liquidus recalescence is sometimes herein called liquidus peak parameter (LPP) and the integrated value for the eutectic arrest is sometimes referred to herein as eutectic arrest peak value (EAPV).

DESCRIPTION OF THE DRAWINGS

FIG. 3 is a graphical illustration of both a measured cooling curve for an unrefined and unmodified SAE 331 aluminum alloy and its derivative peaks derived by use of the present invention;

BEST MODE FOR CARRYING OUT THE INVENTION

The invention herein mathematically manipulates a measured cooling curve in order to accurately predict the metallurgical structure of the casting. Then the quality and mechanical properties such as machinability, tensile strength, ductility (elongation) and fatigue strength can be improved by altering the freezing pattern in response to this prediction.

Castings which contain fine grain size or structure are usually stronger and more ductile and contain less gross segregation and shrinkage than metal castings containing large grain formations. Grain size is related to the number of nucleation sites present in the melt at the liquidus temperature, whereas the eutectic structure is related to the growth process of the nonmetallic second phase. Both must be controlled so that the resultant metal casting is of a finer, more dispersed structure.

Figure 1:
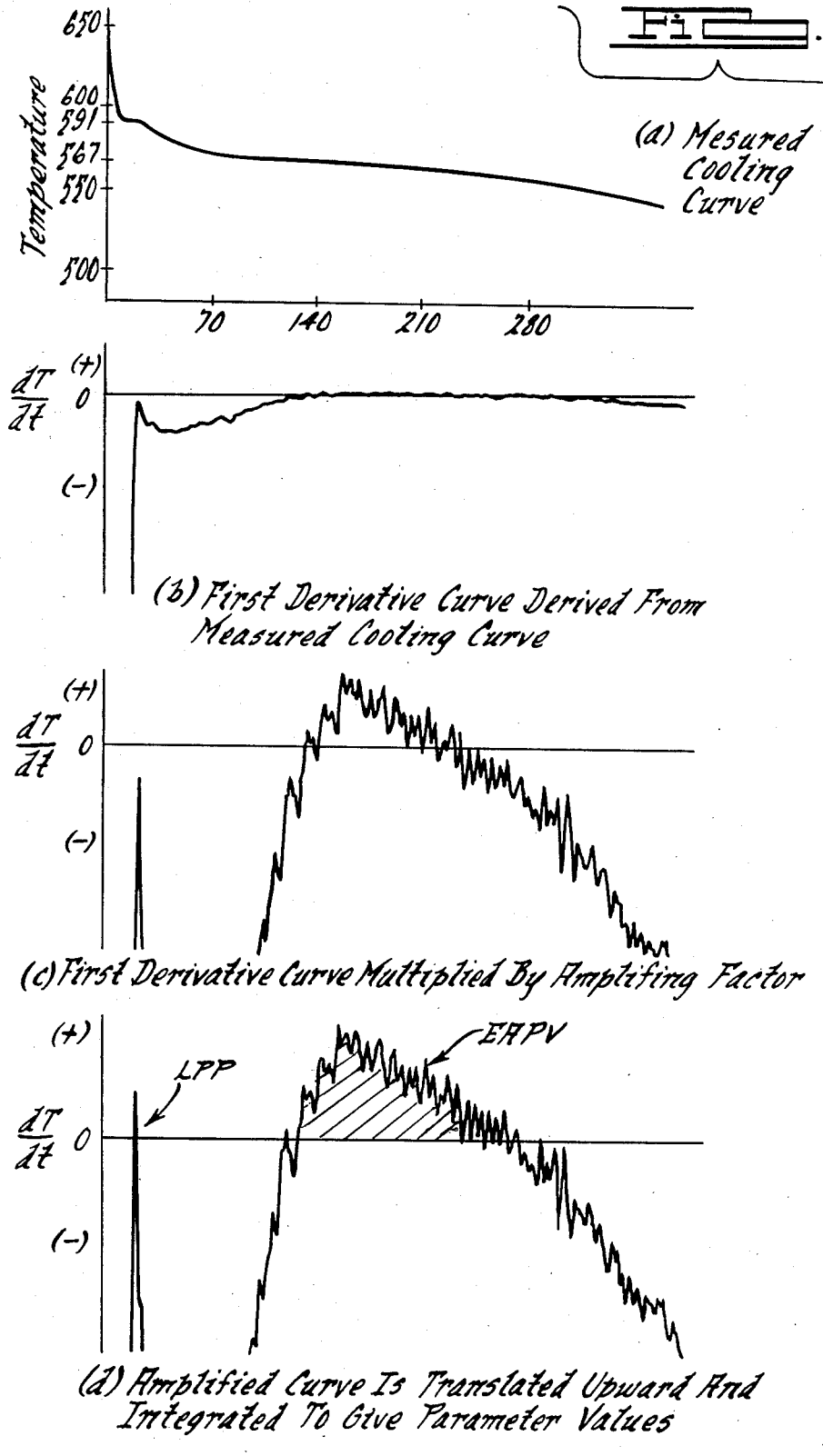
FIG. 1 is a series of graphical illustrations of cooling curve analysis used to derive the liquidus peak parameter (LPP) and the eutectic arrest peak value (EAPV)

A cooling curve, such as that shown in FIG. 1(*a*), shows the temperature/time relationship of a metal as it cools and transforms from liquid to solid. As the metal cools, initial freezing releases some heat, causing a slight rise in the temperature at the liquidus recalescence region. A eutectic arrest occurs somewhat later when the eutectic structure crystallizes; there is only slight change in temperature of the melt during this activity.

Thus, the slope of the cooling curve changes constantly, depending upon the solidification events in the liquid metal. As each solid phase forms, there is a unique slope change in the cooling curve. However, the characteristics of the slope change in a cooling curve are difficult to define quantitatively. This invention uses computer technology to differentiate, multiply, translate, and integrate thereby to clarify and amplify the characteristics of the slope changes in the cooling curve. The two particular metallurgical structures with which this preferred embodiment is associated is that of grain size and eutectic structure. As a result of the mathematical manipulation, a distinctive, measurable and quantitative relationship can be established between the manipulated curve (or the derivative peak values) and the grain size or eutectic structure of the casting. By correlating a wide range of the metallurgical structures (grain size and eutectic morphology) with corresponding manipulated curves from typical castings previously made, a series of standard structure with derivative peak value relationships can be established and stored in a microcomputer controllably attached to the temperature sensing equipment.

Figure 5:
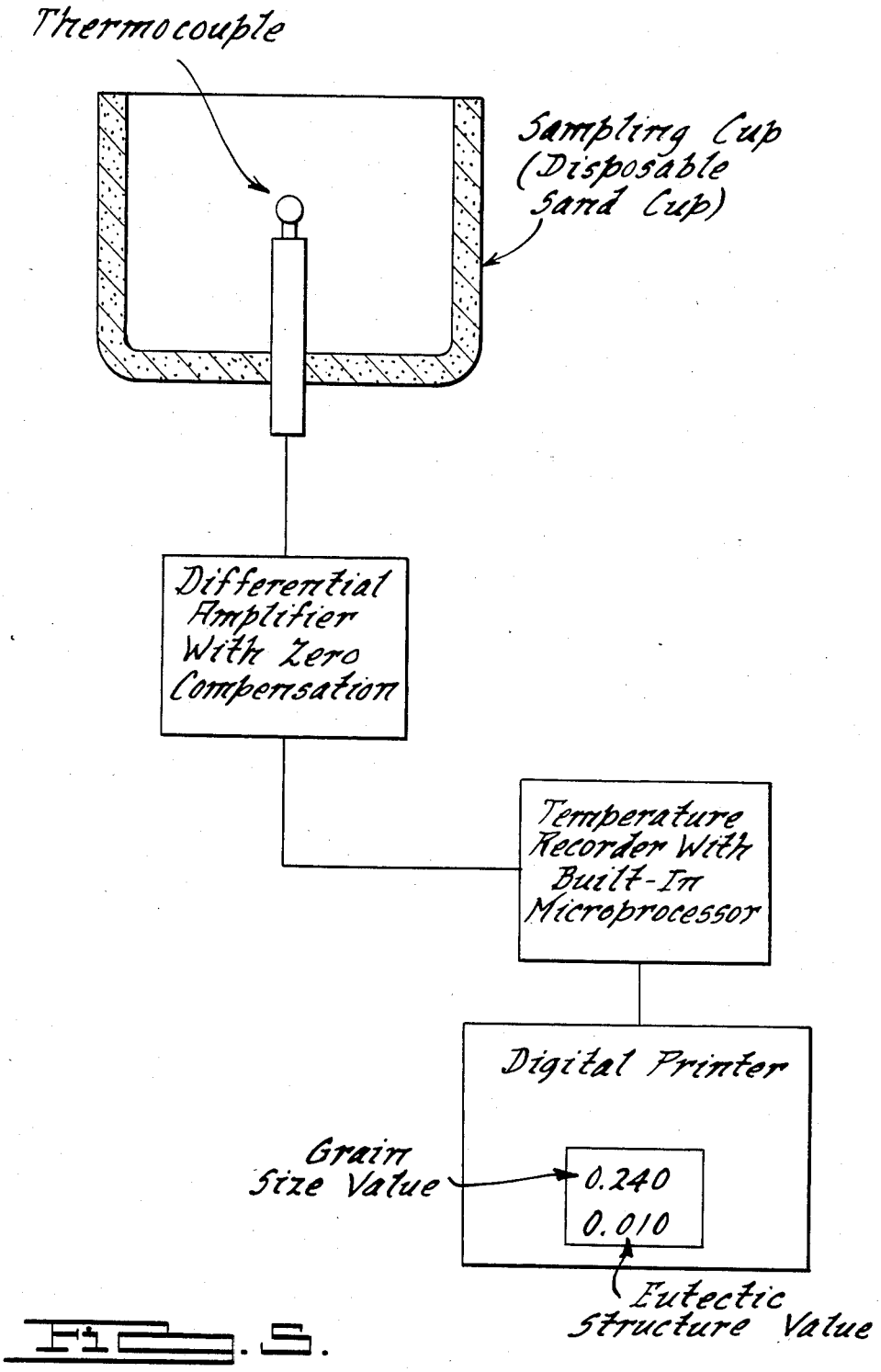
FIG. 5 is a schematic illustration of apparatus that may be used to carry out the method of this invention.

Thus, as shown in FIG. 5, the first operative step is to obtain a measured cooling curve through the use of temperature sensing equipment (thermocouple) placed in the central region of a sampling cup, such sensed temperature values being fed to a temperature recorder with built-in microprocessor where the temperature values are plotted relative to lapse of time and then the mathematical manipulations are instantaneously carried out within the microprocessor rendering mathematical values for LPP which can be correlated to grain size and EAPV which can be correlated to eutectic structure; both values can then be compared to standardized values stored in the microcomputer. The entire operation is rapid, on-line, computer controlled, and does not require highly trained personnel to operate it.

Grain Size

Before proceeding with the specific method, it is best to explain, briefly, the early stage of grain formation. First, with respect to a fine grain structure, it is one that is desired for several reasons: to obtain better casting, including feeding characteristics and reduced shrinkage defects; to improve mechanical properties, especially tensile strength and elongation; and to produce a finer dispersion of microporosity and certain embrittling intermetallic compounds. Grain refinement can be particularly produced by externally applied mechanical action or by the addition of grain nucleating agents or growth inhibitors. The grain structure in a casting is related to the number of nucleation sites present in the melt at the liquidus temperature. If the number of sites is large, many grains can be nucleated with very little or no under-cooling and a fine grain structure will result. However, if few favorable sites are available at the liquidus temperature, significant under-cooling can occur. As more sites become favorable and more grains are nucleated, the heat evolved during solidification raises the melt temperature (called recalescence), allowing growth of existing grains but preventing further nucleation. Thus, fewer grains are formed and a coarse structure results. Generally, the greater the under-cooling, the coarser the grain size and vice-versa. The close relationship of grain size with thermal behavior during the initial stages of solidification allows reliable prediction of grain structure based on analysis of cooling curves around the liquidus region.

Eutectic Structure

Alloys which contain a nonmetallic secondary phase, such as aluminum/silicon alloys, may have a eutectic structure mixture comprised of the base metal and the nonmetallic phase. Under equilibrium conditions, this eutectic structure could be a coarse skeleton of nonmetallic phase, such as silicon, surrounded by the base metal, such as aluminum, in Al-Si alloys. This is due to the fact that in commercial Al-Si alloys, silicon is readily nucleated by various particles, most notably AlP and aluminum itself. On the other hand, silicon does not nucleate aluminum. The silicon leads the growth process in unmodified commercial Al-Si alloys, giving rise to the acicular structure. Additions of small amounts of modifying agents will reverse the order of growth, inhibiting the growth of the silicon into the eutectic liquid and thus allowing the normally trailing aluminum component to envelope it. The result is a finer, more dispersed silicon structure. Both sodium and strontium can be used as eutectic modifiers for aluminum/silicon alloys. Strontium has exhibited superior resistance to fading even when the melt is held in a furnace or ladle after treatment. For an iron/carbon alloy, magnesium can be used as a eutectic modifier. The benefits of eutectic modification include higher tensile strength, hardness, elongation, and improved machinability.

The relationship between eutectic structure and cooling behavior is complex and is not as well understood as grain refinement. The modifying agents, while inhibiting the growth of the nonmetallic phase, also tend to increase the amount of under-cooling. Analysis of the cooling curve in the eutectic region using this method can differentiate between modified and unmodified states.

Sampling Apparatus

The apparatus for carrying out the preferred method mode is schematically shown in FIG. 5 which includes, for example, a 0.005" diameter bare tip, chromel/alumel thermocouple installed upwardly in the center of 1" diameter by 2" high shell sand molded cup. The thermocouple was connected to an amplifier/compensator, and from there to the input terminal of a temperature recording device with a built-in programmable microcomputer. Finally, the recorder was interfaced with a digital printer. The recorder/microprocessor received the temperature values from the thermocouple and programmed them against lapse of time, thereby rendering a set of values which were then mathematically manipulated to derive what is known as liquidus peak parameter and the eutectic arrest peak value. These values were then compared against standardized values for associated microstructures within the microprocessor allowing the microprocessor to display a given grain size and eutectic structure value for the sample.

Commercial Al-Si alloy to be used for casting, such as SAE 331, was melted and kept in a holding furnace at desired temperature, for example, 732° C. (1350° F.). An SAE 331 melt may contain, by weight percent, 8–10% silicon, 3–4% copper, 0.05–0.5% magnesium, and maximum values of, 0.5% for nickel, 1.0% for iron, 0.5% for manganese, 1% for zinc, 0.25% for titanium, and the balance essentially aluminum. Sample melt was cast into the sampling cup whenever there was a need to check the refining and/or modification condition of the melt. The preprogrammed recorder/microprocessor automatically carried out the following series of operations: cooling curve acquisition, various mathematical cooling curve manipulations, comparision of current data with previously gathered data, and finally printed out the results.

Method

The method comprised: (a) determining mathematical values derived from the first derivative curve at liquidus recalescence (LPP) and at eutectic arrest (EAPV) of a measured cooling curve for the metal melt in question, (b) respectively comparing the values with previously gathered values that have been correlated to metallurgical structures, and (c) if one or both of said values are respectively different than the previously gathered values for a desired structure, add refining agents to promote a desired solidification structure change.

With respect to step (a), the derivation of the mathematical value is carried out by first determining the first derivative of a measured cooling curve which will provide a curve such as that shown in FIG. 1(*b*). The first derivative is an essential aspect of the method because it selects the slope change or rate of temperature change as the important mathematical value to be manipulated. Taking the first derivative of a measured cooling curve can be carried out by well known mathematics which include basic calculus. Secondly, the derivative curve is multiplied by a constant, typically in the range of 1–100 to magnify the changes in slope of the original cooling curve. This is best illustrated in FIG. 1(*c*). The multiplying or amplifying factor used for purposes of FIG. 1(*c*) was 20.

Thirdly, the derivative curve was translated upwardly to define a domain of analysis as best illustrated in FIG. 1(*d*). Such translation is usually in the range of 0.1–7, and for purposes of FIG. 1(*d*) was 1. The amount of translation should be sufficient to carry the derivative peaks of both the eutectic arrest and the liquidus regions relevant to structure upwardly above zero slope to maximize utilization of available data.

Lastly, the area under the positive domain of analysis or the portion of the curves above zero slope (cross-hatched) is integrated producing two separate values: one is the liquidus peak parameter, and the other is the eutectic arrest peak value (see FIG. 1(*d*)). These integrated values are used as independent variables in the statistical correlation with previously produced structures.

Establishment of Standard Structure Versus Peak-Value Relationship

Figure 2:
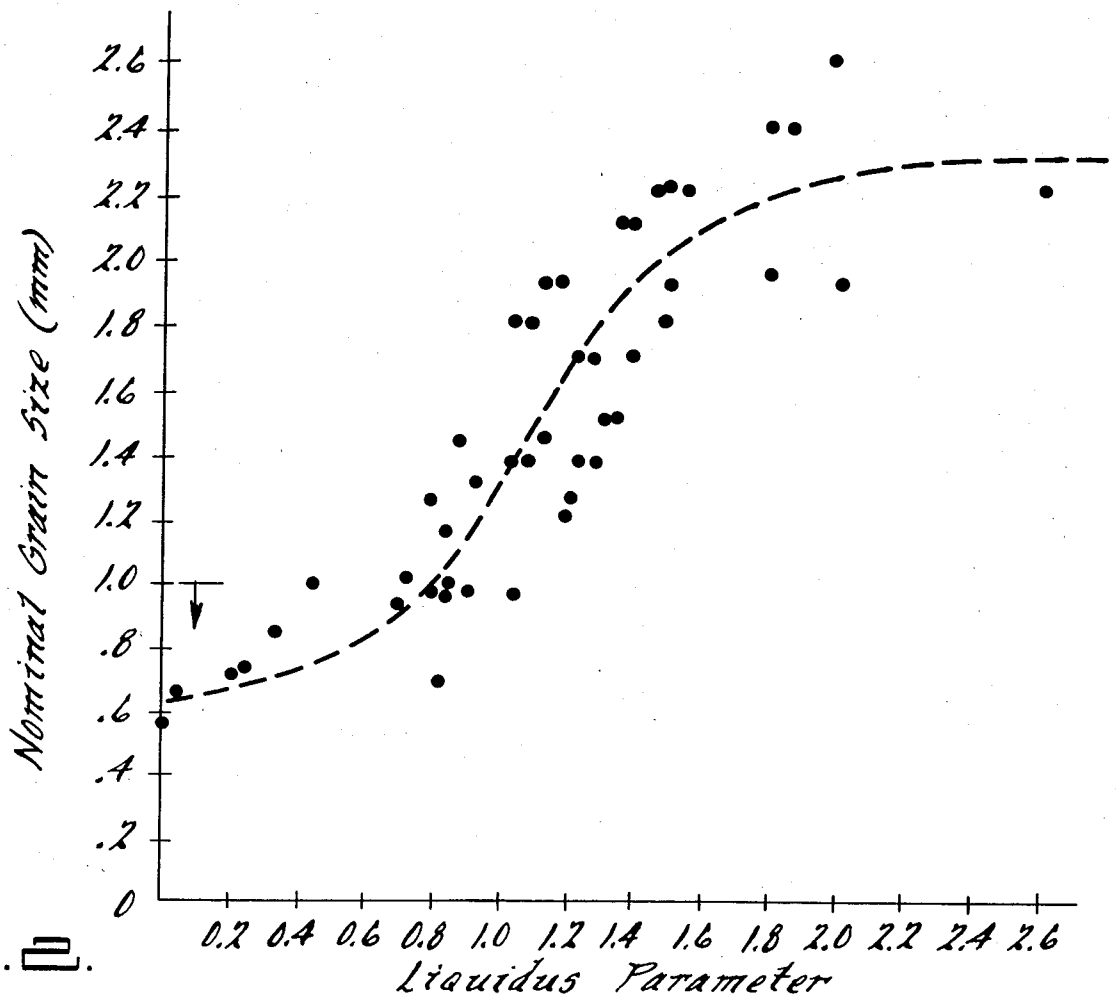
FIG. 2 is a graphical illustration correlating nominal grain size with the liquidus peak parameter (LPP)
Figure 2:
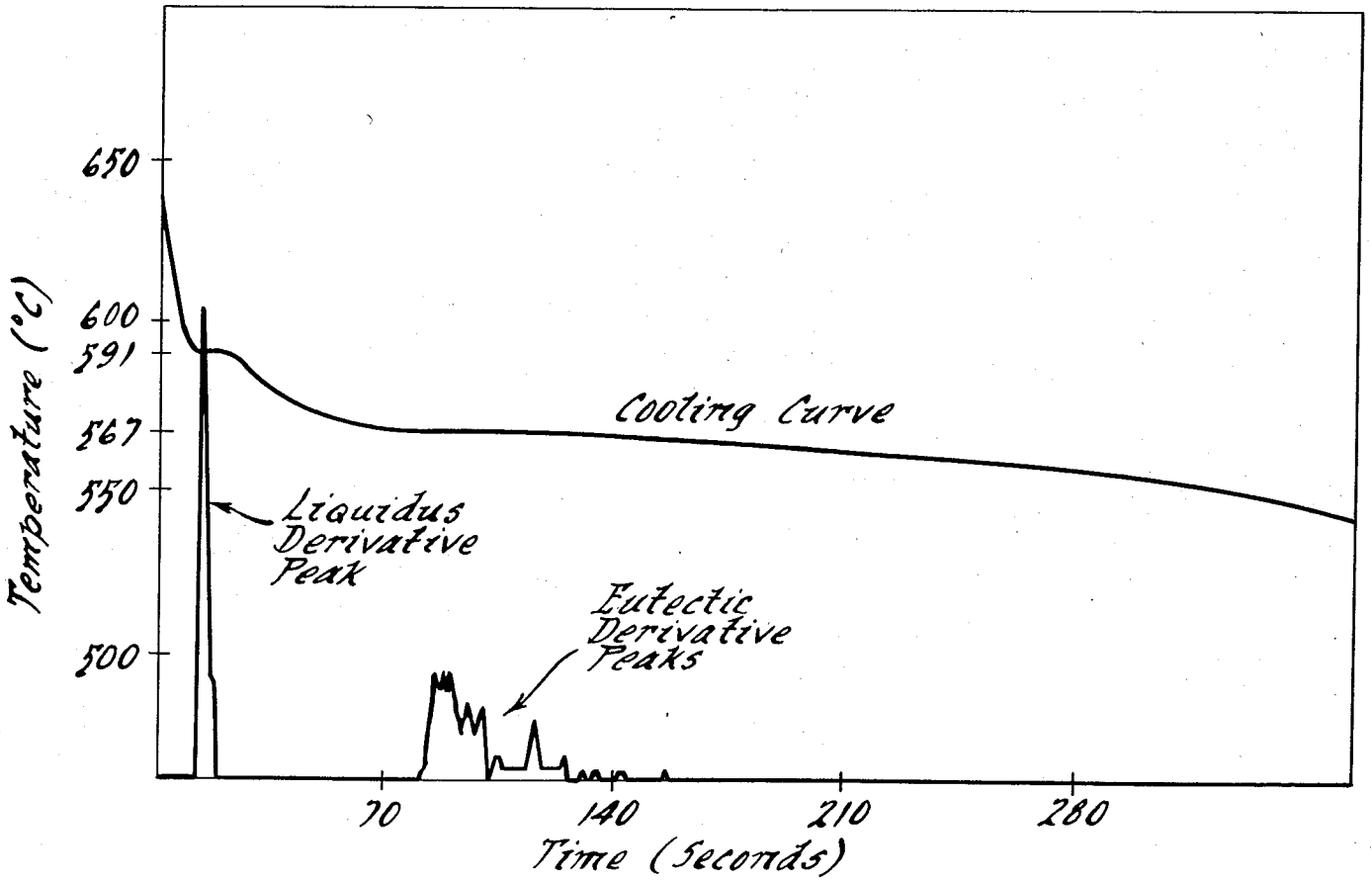

Sufficient number of sample melts with various grain and eutectic structures were previously cast into the same cup and allowed to solidify. LPP and EAPV values for each sample were measured by the recorder/computer in accordance with step (a) described above. The grain and eutectic structures of each sample were determined using traditional metallographic technique. The grain size and the eutectic structure of each sample were then correlated with the LPP and EAPV, respectively. The results of such correlation for grain size versus LPP is illustrated in FIG. 2. The eutectic structure versus EAPV relationship is rather straightforward. The modified and unmodified states are determined by two distinguishing EAPV limits. One is the modified EAPV limit and the other unmodified EAPV limit. An EAPV reading of equal to or larger than the modified EAPV limit indicates acceptable modification. An EAPV reading of equal to or smaller than the unmodified EAPV limit indicates nonmodification. For SAE 331 melt, the standard modified EAPV limit is 3.2 and the standard unmodified EAPV limit is 1.6. Thus, an EAPV reading of 3.2 or larger indicates that the melt will produce castings with modified eutectic structure. On the other hand, if the EAPV reading is 1.6 or smaller, then the melt will produce castings with unmodified eutectic structure.

Once the standard structure versus peak-value relationships have been established, the cast structure of any future melt can be predicted without any metallographic work. Step (a) procedure identical to those used in the above-mentioned standard samples must be applied to future samples.

Having selected the desired grain size and eutectic structure, the correlated LLP and EAPV values for such desired structures is then compared against one or both of the measured values to determine if there is a deviation.

Figure 4:
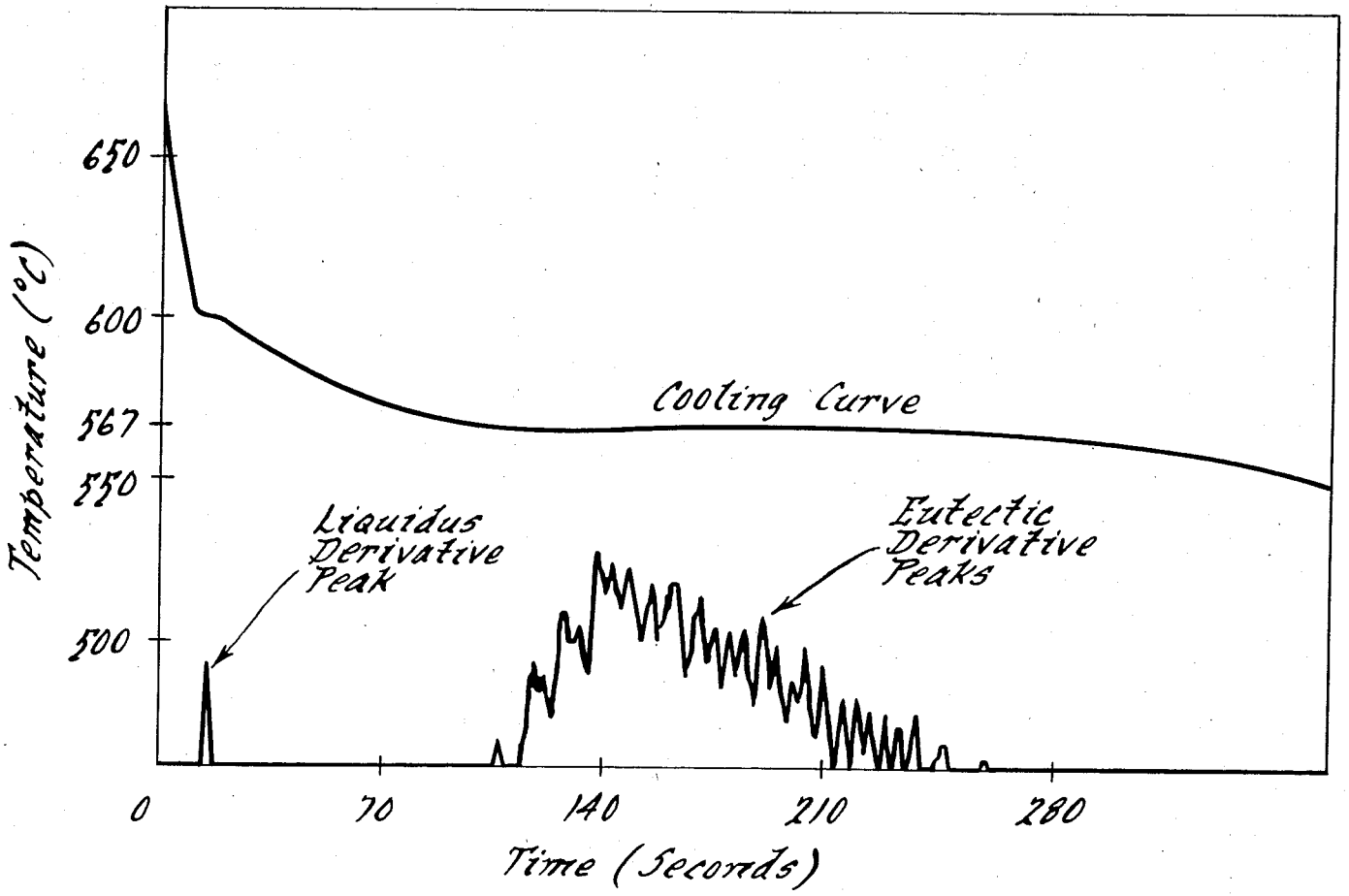
FIG. 4 is a graphical illustration similar to that of FIG. 3 for a grain refined and silicon modified SAE 331 aluminum alloy, again illustrating the shift in the liquidus peak parameter and eutectic arrest peak value.

FIG. 3 illustrates a measured cooling curve for an unrefined and unmodified SAE 331 aluminum alloy, and FIG. 4 shows a measured cooling curve for the same but refined and modified melt after adding grain refiners and silicon modifier. You will note some difference in slope at both liquidus and eutectic regions between these two cooling curves. While there is some difference between the two cooling curves at these locations, the difference is difficult to define quantitatively. However, in direct contrast, the liquidus derivative peak and the eutectic derivative peaks provide integrated values which are very clear to see in terms of their differences. For the unrefined aluminum alloy, FIG. 3, the liquidus derivative peak is extremely large in terms of area under the peak indicating a large grain size, and the eutectic derivative peaks have an area thereunder which is relatively small, indicative of a coarse, acicular type of eutectic structure. In FIG. 4, the difference in the integrated area is substantial after having added the refining and modifying agents in response to what was determined in FIG. 3.

The microprocessor or computer having compared these manipulated peaks with the stored standard data peaks will display the status of the grain refinement and silicon modification. The computer can also calculate the degree of deviation of the current casting structure from the desired structure and give instruction for the corrective action to be taken, for example, how much grain refiner must be added to correct deviation in grain size. Agents for grain refinement are typically titanium and/or boron, or a commercial grain refiner which incorporates titanium and boron in various proportions. Eutectic modifiers typically comprise strontium or sodium, and a typical commercial eutectic modifier comprises 10% strontium, 14% silicon, and the balance aluminum. Such agents are added to the melt and preferably stirred at least five minutes before sampling. The microstructure of the solidified 331 alloy processed by this invention is comprised of a fine aluminum/silicon eutectic mixture, solid solution alpha aluminum grains, small amounts of intermetallic $Mg_2/Si$ particles, and varying amounts of $CuAl_2$ particles, depending on the solidification rate of the sample or casting.

Conclusion

The mathematical manipulation procedure allows detection of minute changes in the cooling curve shape. The translation upwardly of the derivative curve facilitates detection of any recalescence which is too small to produce positive derivatives (that is, slopes which are greater than zero) in the cooling curve; small negative values are thus also included and can be detected. This behavior may occur frequently in well refined melts.

In review, this invention has found first that there is a strong correlation between the liquidus peak parameter and the grain size of typical Al-Si alloy such as SAE 331. Secondly, it has also been found that adequate distinction can be made between the unmodified and the adequately modified structure in terms of eutectic arrest peak values; a value of 1.6 or below identifies the unmodified state, but that a value of 3.2 or greater indicates acceptable modification based upon a qualitative visual assessment of the microstructure.

Proper application of this invention as an on-line quality control tool will result in a rapid, reliable and continuous quality monitoring system. A more uniform and higher quality casting will be produced while minimizing cost for refiners and modifiers and eliminating laborious metallographic work. The invention can also be applied to other Al-Si alloy castings or other engineering and scientific analyses which deal with similar curve data characteristics.

We claim:

1. A method of controlling the metallurigical structure of cast metals containing nonmetallic second phase structures, comprising:

(a) prior to casting a melt of said metal, determining a mathematical value based on the rate of temperature change at liquidus recalescence and a value based on the rate of temperature change at the eutectic arrest of a measured cooling curve for a sample of said metal melt, said values being determined by (1) recording temperature variation as a function of time during solidification of said sample, (2) taking the first derivative of said variation to represent the rate of temperature change, (3) amplifying and clarifying said first derivative to define a domain of analysis about the liquidus recalescence and/or the eutectic arrest, and (4) integrating the domain of analyses to render said mathematical values;

(b) comparing the determined value based on liquidus recalescence and the determined value based on eutectic arrest with previously gathered values of the same type that have been correlated to known metallurgical structure; and (c) if one or both of said determined values are different than the previously gathered values for a desired similar structure, respectively, add refining and/or eutectic modifying agents to the melt to promote a desired metallurgical structure change.

2. The method as in claim 1, in which the melt is aluminum with a minor amount of silicon, and the refining agents employed to promote a desired change in liquidus recalescence comprise titanium and/or boron.

3. The method as in claim 1, in which the melt is aluminum with a minor amount of silicon, and the modifying agents added to promote a desired change in the eutectic arrest comprise sodium and/or strontium.

4. The method as in claim 3, in which said silicon is present in said aluminum in the range of 5–12% by weight.

5. The method as in claim 2, in which said silicon is present in an amount of 5–12% by weight of said aluminum.

6. A method for rapidly, reliably and continuously monitoring the quality of the metallurgical structures from an alumnium based melt, comprising:

(a) determining a first derivative mathematical value based on the rate of temperature change at liquidus recalescence and at eutectic arrest portions of a measured cooling curve for said aluminum alloy melt; and (b) comparing said values with the same type of values correlated to known metallurgical structures and if the correlated structure is undesirable, taking corrective action to achieve desired metallurgical structure by addition of grain refiners or eutectic modifiers.

7. The method as in claim 6, in which the mathematical value based on the rate of temperature change is determined by (a) taking the first derivative curve of the measured cooling curve, (b) multiplying said first derivative curve and translating said multiplied first derivative curve to raise the liquidus recalescence peak and eutectic arrest peaks above zero slope sufficiently to define a domain of analysis, and (c) integrating the area under the domain of analysis for each of the peaks to render said respective mathematical values.

8. The method as in claim 7, in which the multiplying factor is in the range of 1–100 and said translation amount is in the range of 0.1–7.

9. The method as in claim 6, in which said measured cooling curve is obtained by plotting sensed temperature values relayed from a theromocouple extending centrally within said melt sample.

10. The method as in claim 6, in which said comparison is carried out by use of a computer containing stored information of the correlated metallurgical sturctures.

11. A method of controlling the metallurgical structure of cast aluminum metals containing nonmetallic second phase structures, comprising:

(a) thermally analyzing a plurality of said cast aluminum metal sturctures by (1) plotting a cooling curve showing temperature as a function of time for a sampled portion of an aluminum based alloy melt, (2) maipulating and isolating a portion of the cooling curve at the liquidus recalescence and at the eutectic arrest to generate a graphically integrated value based on first derivative values at recalescence and eutectic arrest, which integrated values detect minute changes in the cooling curve shape; and (b) associating the liquidus recalescence value with the closest previously recorded liquidus recalescence value correlated with grain size to determine if the associated correlated grain size is acceptable and, if not, modifying the melt by addition of grain refiners to change the grain nucleation.

12. A method for monitoring the quality of the metallurgical structures from an aluminum based melt, comprising:

(a) recording the variable relationship of temperature as a function of time for the solidification of a portion of said melt;

(b) forming the first derivative of the relationship of step (a) magnifying and shifting said formed derivative in a manner to expose a desired positive domain between said formed derivative and zero derivative for at least recalescense and for eutectic arrest;

(c) integrating the area of said domain to provide a derived liquidus peak paramenter and a derived eutectic arrest peak value; and (d) comparing said derived liquidus peak parameter and derived eutectic arrest peak value with similar liquidus peak parameters and similar eutectic arrest peak values correlated to known metallurgical structures, and if the correlated known structure is undesirable, taking corrective action to acheive the desired metallurgical structure by addition of grain refiners or eutectic growth modifiers.

13. The method as in claim 11, in which step (b) additionally includes associating the eutectic arrest value with the closest previously recorded eutectic value correlated with eutectic structure to determine if the associated correlated eutectic structure is acceptable and, if not, adding modifiers to the melt to improve the eutectic structure.

* * * * *